US006779208B2

(12) United States Patent
Lim et al.

(10) Patent No.: US 6,779,208 B2
(45) Date of Patent: Aug. 24, 2004

(54) FOLDING BED

(75) Inventors: Jerry Lim, Singapore (SG); John M. Elliott, Edina, MN (US)

(73) Assignee: Sico Incorporated, Edina, MN (US)

( * ) Notice: Subject to any disclaimer, the term of this patent is extended or adjusted under 35 U.S.C. 154(b) by 0 days.

(21) Appl. No.: 10/215,256

(22) Filed: Aug. 7, 2002

(65) Prior Publication Data

US 2003/0121099 A1 Jul. 3, 2003

(51) Int. Cl.[7] ..... A47C 17/52

(52) U.S. Cl. ..... 5/136; 5/2.1; 5/159.1; 5/167

(58) Field of Search ..... 5/136, 133, 2.1, 5/159.1, 162, 163, 164.1, 167, 168

(56) References Cited

U.S. PATENT DOCUMENTS

| | | | | | |
|---|---|---|---|---|---|
| 307,013 | A | * | 10/1884 | Carleton | 5/2.1 X |
| 357,530 | A | * | 2/1887 | Krause | 5/2.1 X |
| 481,385 | A | * | 8/1892 | Barger | 5/2.1 |
| 956,340 | A | * | 4/1910 | Haley | 5/43 |
| 1,091,494 | A | * | 3/1914 | Fillmore et al. | 5/159.1 X |
| 1,091,495 | A | * | 3/1914 | Filllmore et al. | 5/159.1 X |
| 1,924,945 | A | | 8/1933 | Klotz | 108/1 |
| 2,504,769 | A | * | 4/1950 | Watter | 5/167 X |
| 2,514,032 | A | * | 7/1950 | Dean et al. | 5/136 |
| 2,556,141 | A | * | 6/1951 | Mayer et al. | 5/167 X |
| 2,564,512 | A | * | 8/1951 | Specht | 5/2.1 |
| 2,634,433 | A | * | 4/1953 | Woller | 5/167 X |
| 2,771,937 | A | | 11/1956 | Wilson | 297/158.4 |
| 2,782,075 | A | | 2/1957 | Fagan | 182/152 |
| 3,028,197 | A | | 4/1962 | Wilson | 297/124 |
| 3,046,572 | A | * | 7/1962 | Eames et al. | 5/136 |
| 3,088,127 | A | * | 5/1963 | Eames | 5/2.1 |
| 3,099,480 | A | | 7/1963 | Wilson | 297/158.4 |
| 3,877,086 | A | | 4/1975 | Bue et al. | 5/91 |
| 3,900,905 | A | | 8/1975 | Johnson et al. | 5/2.1 |
| 3,999,245 | A | | 12/1976 | Bue et al. | 16/289 |
| 4,100,858 | A | | 7/1978 | Bue et al. | 108/48 |
| 4,136,622 | A | | 1/1979 | Bue et al. | 108/48 |
| D257,623 | S | | 12/1980 | Bue et al. | D6/393 |
| 4,337,670 | A | | 7/1982 | Carlson | 74/96 |
| 4,449,263 | A | | 5/1984 | Wilson et al. | 5/133 |
| 4,592,105 | A | | 6/1986 | McNamara | 5/238 |
| 4,793,011 | A | | 12/1988 | Eve | 5/136 |
| 4,885,813 | A | | 12/1989 | McNamara | 5/136 |
| D327,779 | S | | 7/1992 | Jensen et al. | D6/337 |
| 5,136,737 | A | * | 8/1992 | Reppas et al. | 5/2.1 |
| 5,353,452 | A | * | 10/1994 | Rulis | 5/136 |
| 5,446,932 | A | | 9/1995 | Voorhis | 5/137 |
| 5,522,097 | A | | 6/1996 | Ciccotelli | 5/37.1 |
| 5,621,930 | A | * | 4/1997 | Reppas et al. | 5/136 |
| 5,652,978 | A | | 8/1997 | Wiig | 5/144 |
| 5,906,015 | A | | 5/1999 | Hilger et al. | 5/136 |
| D413,734 | S | | 9/1999 | Bue | D6/337 |
| 6,212,710 | B1 | | 4/2001 | Jones | 5/118 |
| 6,405,392 | B2 | * | 6/2002 | Schwalbe, Jr. | 5/133 X |
| 6,574,807 | B1 | * | 6/2003 | Gonzalez | 5/159.1 |
| 2001/0044960 | A1 | * | 11/2001 | Schwalbe, Jr. | 5/136 |
| 2003/0121099 | A1 | * | 7/2003 | Lim et al. | 5/136 |

FOREIGN PATENT DOCUMENTS

| | | | | |
|---|---|---|---|---|
| BE | 0630136 | * | 4/1963 | 5/2.1 |
| EP | 0011531 | * | 5/1980 | 5/133 |
| FR | 2464042 | * | 3/1981 | 5/2.1 |
| SE | 0039488 | * | 10/1915 | 5/2.1 |
| SU | 0124611 | * | 1/1949 | 5/2.1 |

* cited by examiner

*Primary Examiner*—Robert G. Santos
(74) *Attorney, Agent, or Firm*—Merchant & Gould PC

(57) ABSTRACT

A folding bed includes a support frame with a bed having a frame. A linkage connects the bed frame to the support frame and enables folding of the bed frame between a substantially horizontal position and a substantially vertical position. A selectively foldable seat mounts to an underside of the bed frame and has a linkage and folding legs actuatable independently of the bed's folding linkage.

24 Claims, 15 Drawing Sheets

FOLDING BED

BACKGROUND OF THE INVENTION

1. Field of the Invention

The present invention relates generally to folding beds. More particularly, the invention relates to a folding bed with an attached folding bench.

2. Description of the Prior Art

Wall beds and similar folding beds, often referred to as Murphy beds, have been in use for many years. Folding beds are moveable between a substantially vertical storage position to a substantially horizontal position, and visa versa. When in the lowered position, a folding bed may appear to be similar to a normal bed, sometimes with a headboard such as the retractable headboard disclosed in U.S. Pat. No. 5,446,932 to Bue, and assigned to SICO, Inc. When in the raised position, the folding bed is typically confined folded into a wall or storage cabinet in the wall, where it is concealed. These beds provided greater utility of the space, saving space over conventional beds and allowing multiple wide ranging uses of the room with quick and easy conversion between a sleeping room and another use. This cabinet may include shelves or a desk such as the folding beds disclosed in U.S. Pat. Nos. 6,212,710B1 and 4,793,011.

A folding bed cabinet may include a built-in seat or bench that is usable only when the bed is in the upright position. U.S. Pat. No. 5,652,978 discloses such a folding bed with a seating bench that automatically extends upward into a seating position as the bed folds into an upright position. A drawback to this type of seating bench and folding bed combination is that the bench does not have the option of being folded up, down or otherwise out of the way when the bed is in the upright position. Consequently, the folded bed takes up more floor space and is not as versatile for purposes of compact storage of the bed.

A folding bed may further include storage space within or adjacent to the storage space allocated for the folding bed. U.S. Pat. No. 6,212,710B1 illustrates cupboards included in a folding bed cabinet. U.S. Pat. No. 5,522,102 discloses an enclosure unit partially surrounding and removable from the lower portion of an upright bed frame. These designs have various constraints including, for example, size, permanency, easy of access, and manufacturability.

It can be seen then that a new and improved folding bed is needed that overcomes the problems with the prior art. An improved folding bed should provide a more versatile folding seat that requires less overall floor space when the bed is in the upright storage position. An improved folding bed should also provide an adjacent storage space with advantages over the prior art. The present invention addresses these as well as other problems associated with folding beds.

SUMMARY OF THE INVENTION

The present invention is directed to a folding bed, and in particular to a folding bed having a folding bed assembly and an independently actuated folding seat assembly. The bed assembly and seat assembly are supported on a frame that may be utilized with a storage compartment or locker and incorporated into a cabinet or a recess in the wall or may be self-standing and supported on casters, providing for easily moving the bed between various locations.

The bed assembly includes a mattress mounted to a bed frame and retained with a strap. Folding legs extend outward from the extended edge of the bed frame and provide support in unfolded position. The bed assembly folds along one of its sides between an unfolded use position wherein the mattress and bed frame are substantially horizontal for sleeping, and a folded storage position, wherein the mattress and bed frame are substantially vertical. The bed assembly includes a linkage having a link connecting the support frame to the folding legs. The bed frame pivots near a center portion at each end of the bed frame on the support frame. The bed linkage automatically retracts and extends the folding legs as the bed is folded and unfolded. A counterweight and/or one or more gas springs may be utilized to balance the bed so that the folding may be easily accomplished with minimal effort.

The bed assembly also includes a lock with a handle mounted in the bed frame and flush with an outer surface of the bed frame in a non-actuated position. The lock is depressible to actuate a shaft extending through the bed frame to the inner side of the bed to engage one of two brackets, each configured for receiving the extended shaft, A first bracket receives the shaft in the unfolded use position and a second bracket receives the shaft in the folded stored position.

The seat assembly includes a seat back mounted to an underside of the bed frame and a seat bottom extending outward from a strut extending outward from an underside of the bed frame transverse to the plane of the bed frame. The seat bottom folds between a position substantially flush against the seat back and an extended use position. Folding legs mount to a seat frame near an outer edge to provide sufficient load capacity to support several persons on the seat. The seat linkage includes a link connecting the legs to the support frame so that the legs automatically retract in the storage position and extend in the use position. A lock mounts to one of the folding legs for the seat and includes a spring-loaded actuator handle and an engagement pin. The engagement pin extends through the leg to engage the bed frame when the seat is in the folded stored position. The lock prevents accidental folding of the seat assembly.

The present invention may also include a cabinet covering the mechanisms as well as the bed assembly and seat assembly. It can be appreciated that the present invention provides full access for cleaning the floor and minimal extension outward with side folding and a balanced folding mechanism mounting from an upright portion of the wide base of the support frame.

These features of novelty and various other advantages that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

Referring now to the drawings, wherein like reference numerals and letters indicate corresponding structure throughout the several views.

DETAILED DESCRIPTION

Figure 1:
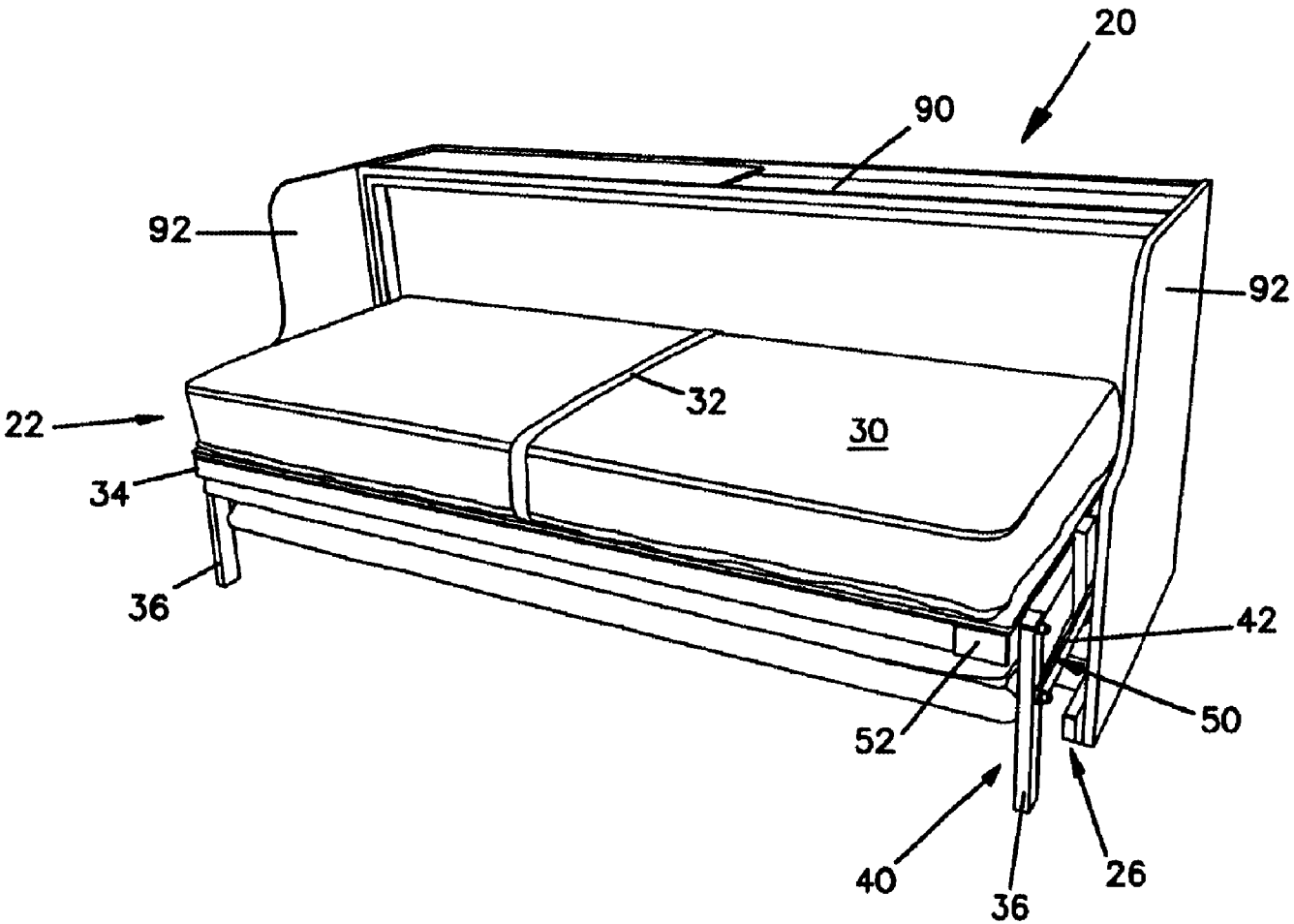
FIG. 1 shows a perspective view of a first embodiment of a folding bed with the bed unfolded according to the principles of the present invention.
Figure 2:
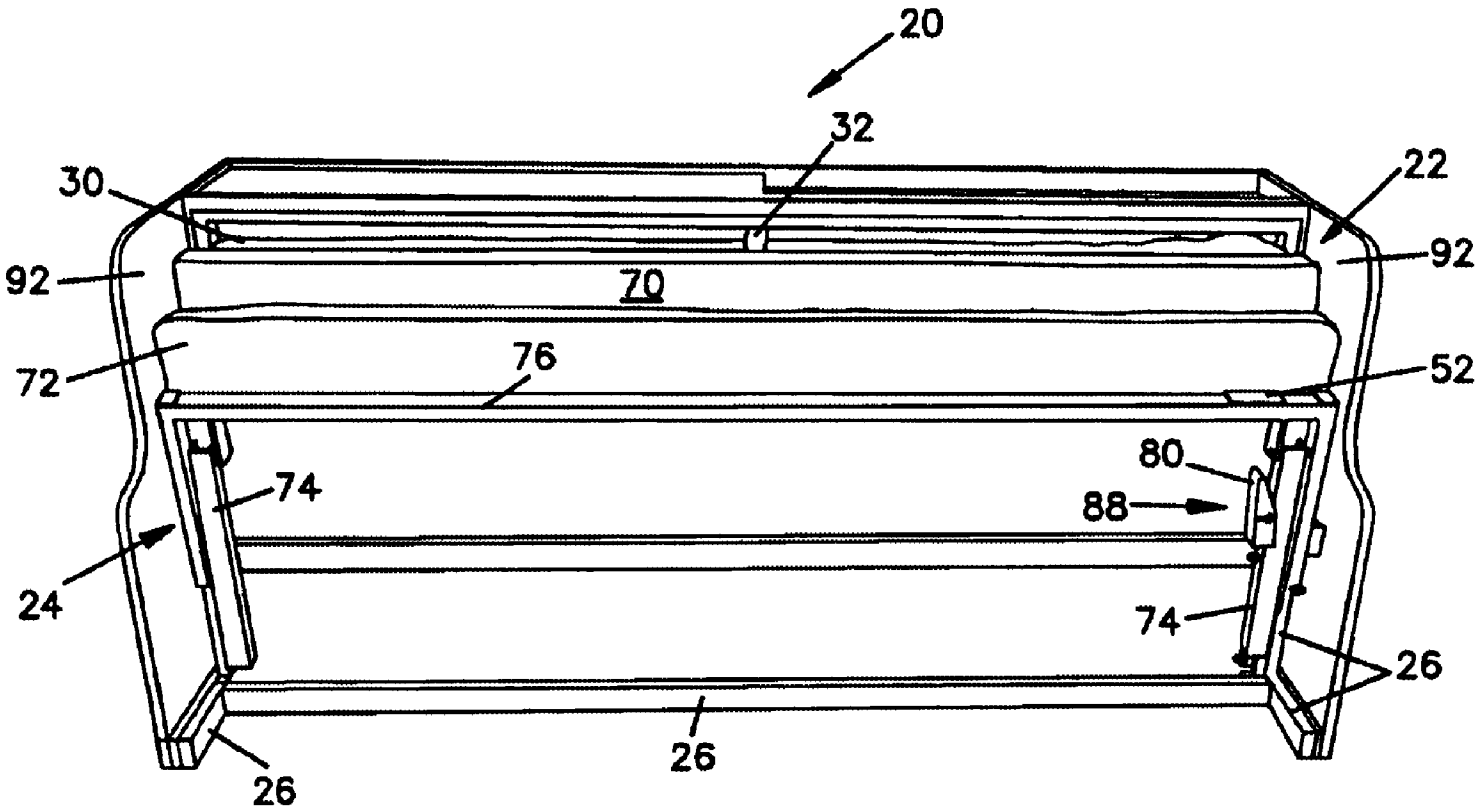
FIG. 2 shows a perspective view of the bed of FIG. 1 with the bed assembly folded and the seat assembly folded.
Figure 3:
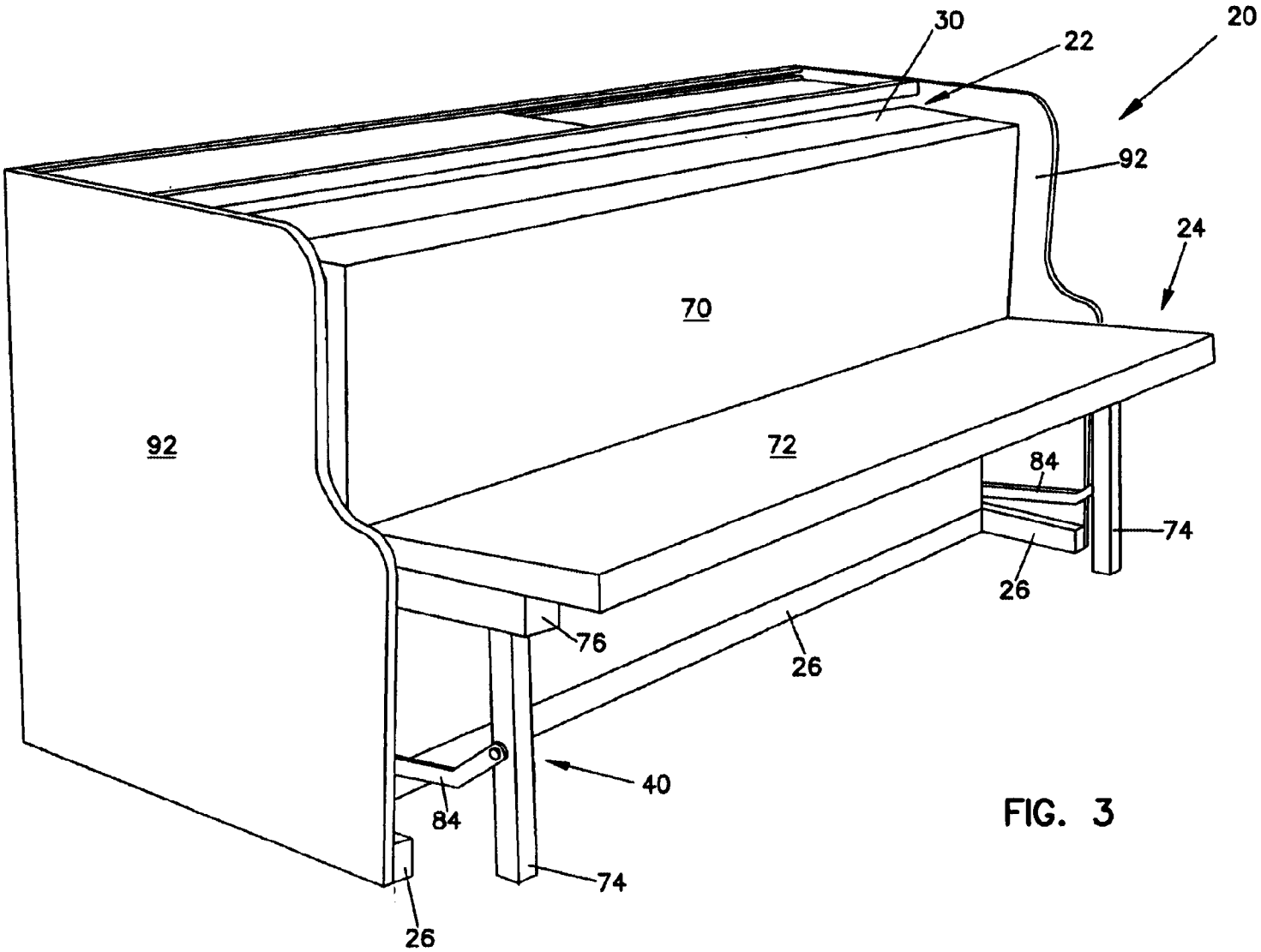
FIG. 3 shows a front elevational view of the bed of FIG. 1 with the bed assembly folded up and the seat assembly unfolded.

Referring now to the drawings, particularly FIG. 1, there is shown a folding bed, generally designated 20. The folding bed 20 includes a folding bed assembly 22 and a folding seat assembly 24 that are actuatable independently of one another. The bed 20 is supported by support frame 26 having a wide base with a vertical portion extending upward there from. The bed 20 also may include a storage compartment or locker 90 situated behind the bed and against which the bed assembly 22 folds when in the storage position. The storage compartment 90 may have sliding doors to provide easy access with room to keep bed linens, pillows and other accessories at a convenient location. Although the present invention is freestanding on the support frame 26, it could also be mounted into a wall and pulled outward from there. If freestanding, the bed 20 typically includes a cabinet 92 receiving the bed assembly 22, the seat assembly 24, and the storage compartment 90. The bed assembly 22 folds between the use position shown in FIG. 1 and the storage position shown in FIG. 2. Unlike typical prior art wall beds, which fold from one of their ends, the bed 20 has the bed assembly 22 fold along one of its sides. The seat assembly folds between a storage position shown in FIGS. 1 and 2 and a use position shown in FIG. 3.

The bed assembly 22 includes a mattress 30 supported on a substantially horizontal bed frame 34. A strap 32 extends around the mattress 30 and maintains it in position against the bed frame 34 when folded and unfolded. The configuration of the bed assembly 22 is such that the mattress 30 is never folded, unlike the typical sleeper couch. When unfolded, two legs 36 support the bed frame 34, one at each of the corners at the extended edge of the bed frame 34.

Figure 4:
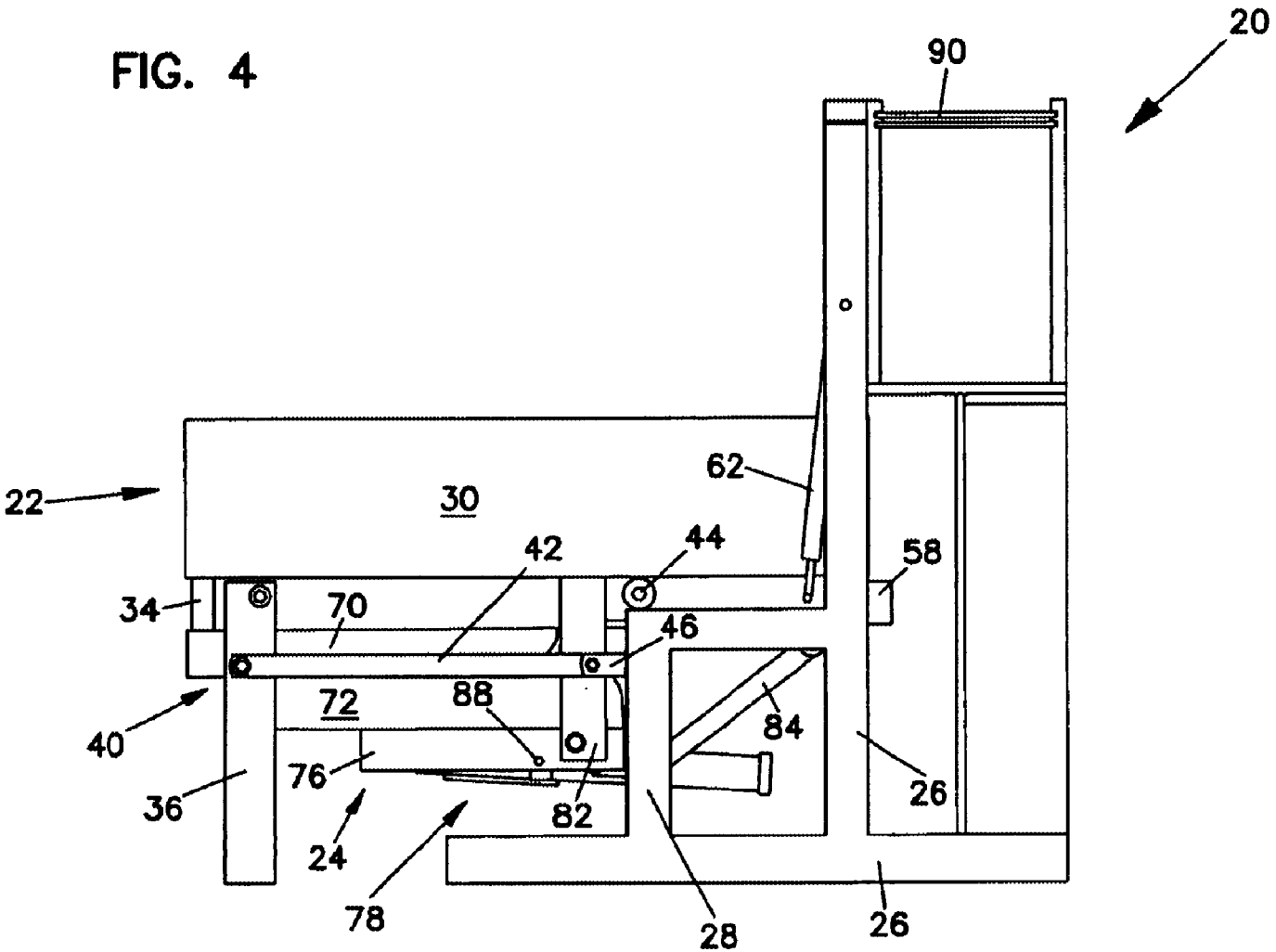
FIG. 4 shows a right end elevational view of the bed of FIG. 1 in an unfolded position.
Figure 5:
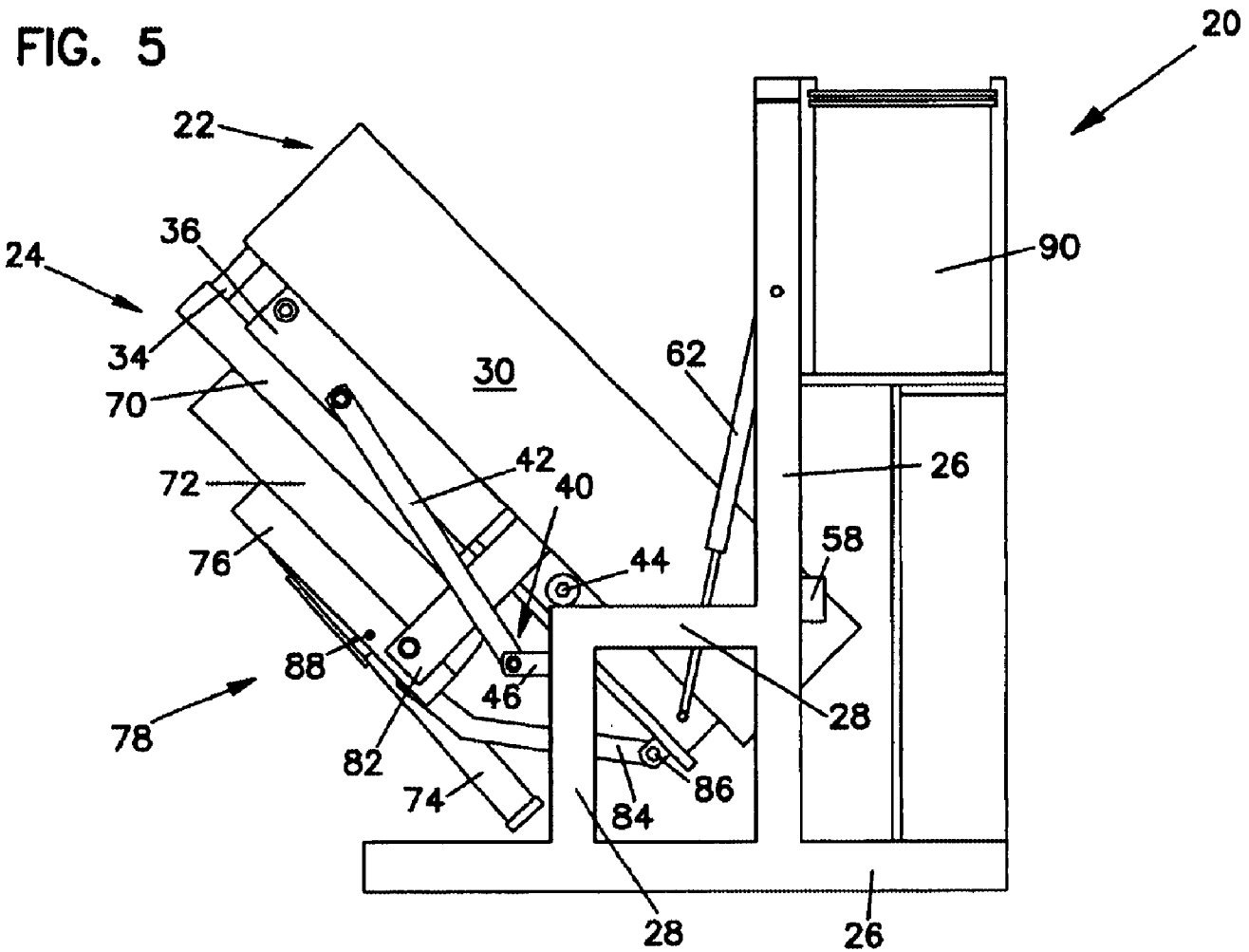
FIG. 5 shows a right end elevational view of the bed of FIG. 1 in a partially folded position.
Figure 6:
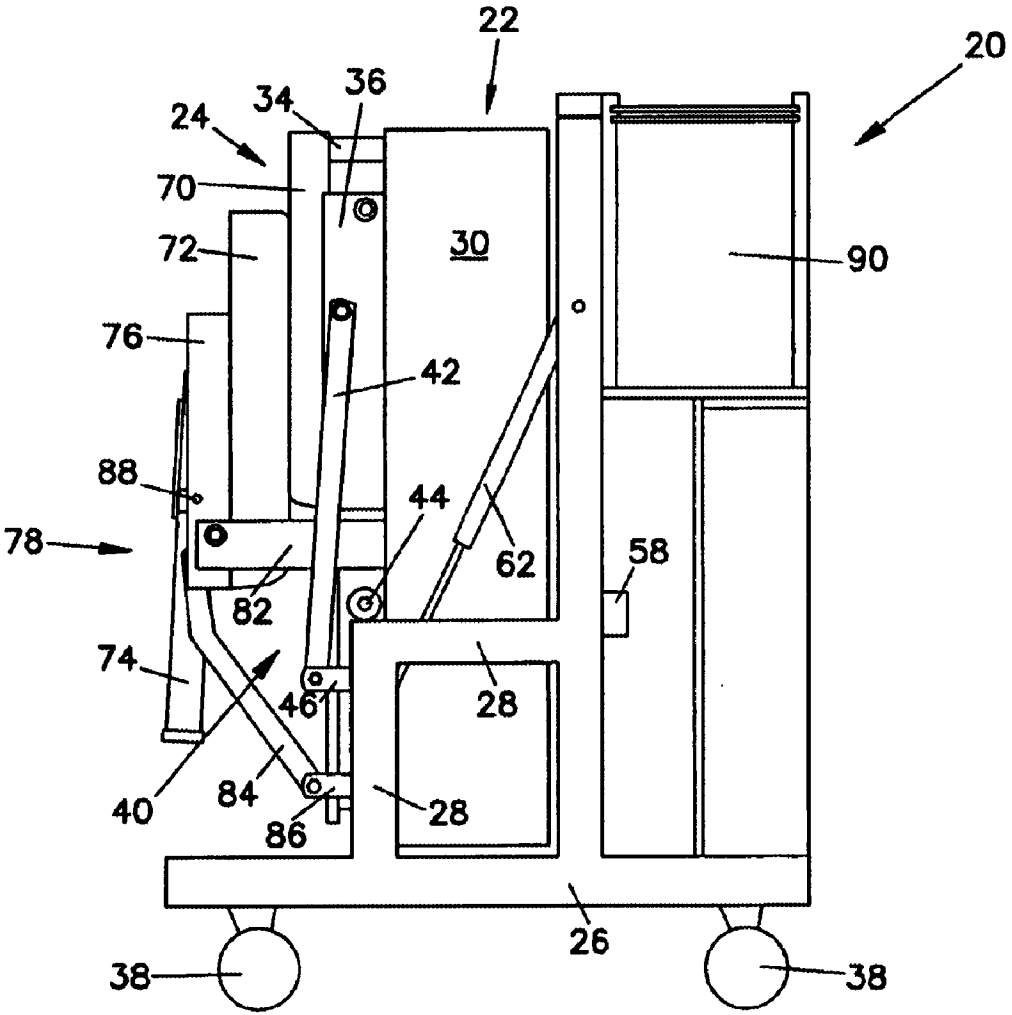
FIG. 6 shows a right end elevational view of the bed of FIG. 1 in a folded storage position.

As most clearly shown in FIGS. 4–6, the bed assembly includes a folding linkage 40 which facilitates folding of the bed assembly 22 from an unfolded use position, as shown in FIG. 4, through an intermediate position, shown in FIG. 5, to a folded storage position, shown in FIG. 6, and back. The bed assembly 22 folds so that the bed frame 34 is substantially horizontal in the unfolded use position shown in FIG. 4, and substantially vertical in the folded storage position, shown in FIG. 6. The folding linkage 40 mounts on the support frame 26 with a tab 46 extending horizontally from the rectangular portion 28, acting as a linkage support. A main pivot 44 of the bed assembly 22 is positioned just above and at an outer end of the linkage support portion 28 of the frame 26. A first link 42 pivotally mounts to the tab 46 on one end and to a folding leg 36 at the extended end. Each of the legs 36 also pivotally mounts to a side of the bed frame 34 near an outer edge of the bed frame. As shown in FIG. 5, as the bed assembly 22 is unfolded, the linkage 40 rotates the legs 36 outward from a position beside an end of the bed frame 34. To facilitate folding, in a preferred embodiment, the bed frame 34 includes a counterweight in the frame to provide balance about the pivot 44. A gas spring 62 mounts between the support frame 26 and the bed frame 34. Although one gas spring 62 is shown mounted at one end of the bed 20, various gas springs of various sizes and having various damping characteristics, or combinations of two or more gas springs 62 may be utilized in the present invention at one or both ends of the bed 20. As shown in FIG. 6, when the bed 20 is positioned with the bed assembly 22 in the folded storage position, the bed linkage 40 automatically positions the bed frame 34 at a substantially vertical position. In addition, the folding legs 36 of the bed assembly 22 are also retracted to a position extending outward from and collinear with an edge of the bed frame 34.

As shown in FIG. 6, further unfolding moves the bed assembly legs 36 to a substantially vertical position transverse to the bed frame 34. Moving the bed assembly 22 from an unfolded position to a folded position moves the bed assembly legs 36 back to their substantially vertical stored position, retracted against the bed frame 34. When fitted with casters 38, at the folded position, the bed 20 is free to me moved and may be easily rolled from location to location.

Figure 7:
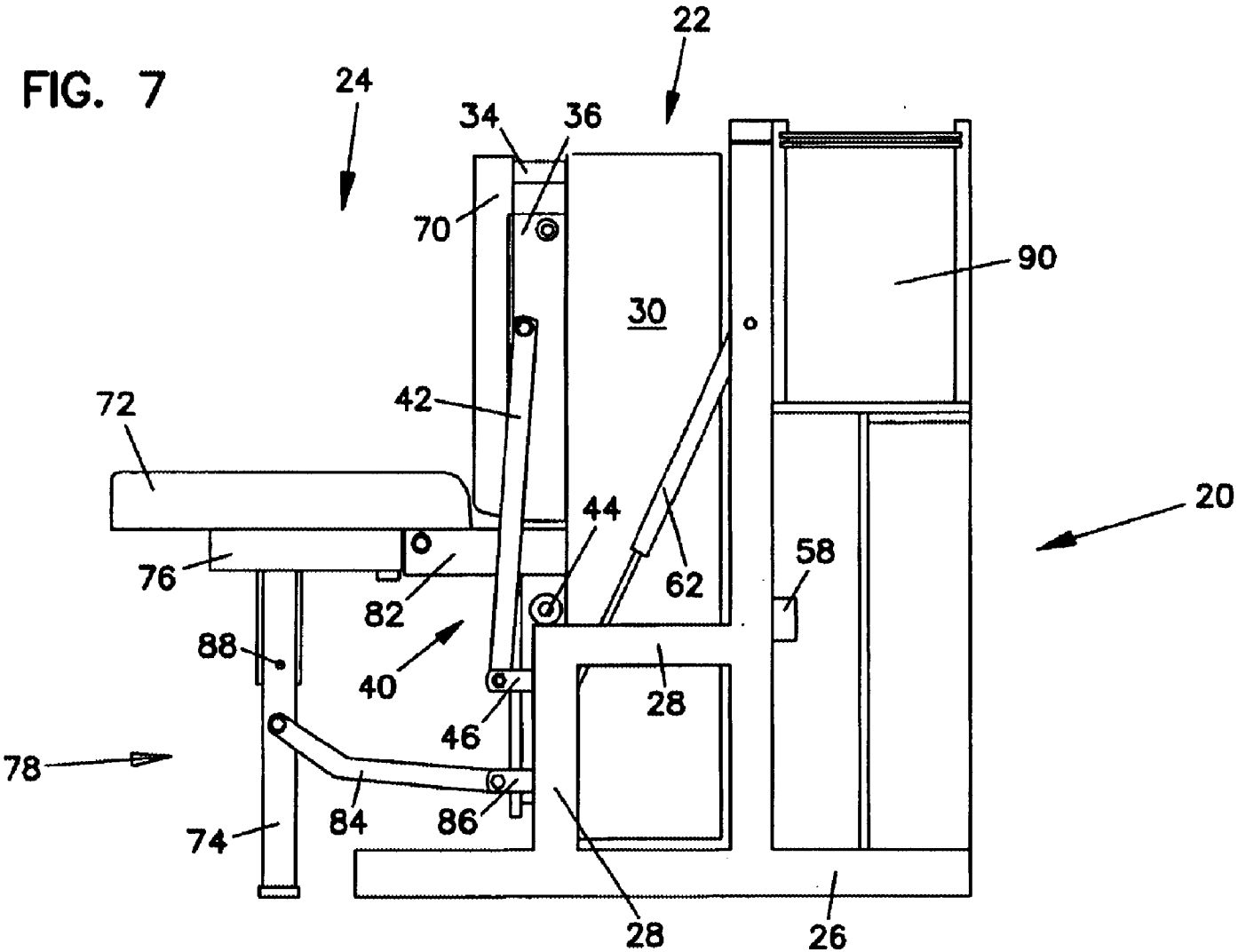
FIG. 7 shows a right end elevational view of the bed of FIG. 1 with the seat unfolded.
Figure 8:
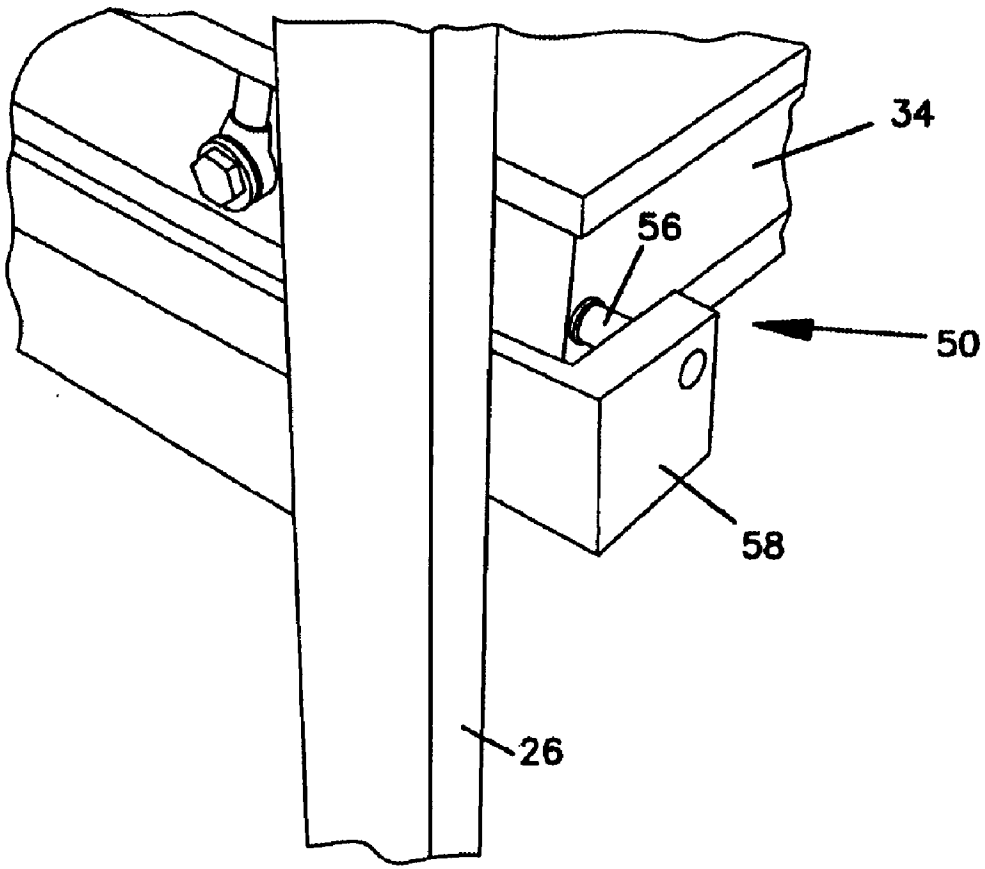
FIG. 8 details shows a detail view of a first lock receiver bracket for the folding bed of FIG. 1.

Referring now to FIGS. 6 and 7, the seat assembly 24 includes a seat back 70 and a seat bottom 72 that folds between a use position and a storage position. Seat back 70 is mounted substantially flush against the underside of the bed frame 34. The seat back 70 and seat bottom 72 may be cushioned but may also be hard surfaces. In addition, the cushions may be removable from the seat assembly 24. It will be appreciated that in the unfolded position, the seat assembly 24 provides comfortable seating and support for the backs of several seated users. Moreover, the seat assembly 24 includes folding seat legs 74 positioned near the extended edge of a seat frame 76 from the seat bottom 72 so that rigid support is provided. With the legs 74 and the support frame 26, substantial load capacity is provided to accommodate seating of several persons on seat assembly 24.

Figure 9:
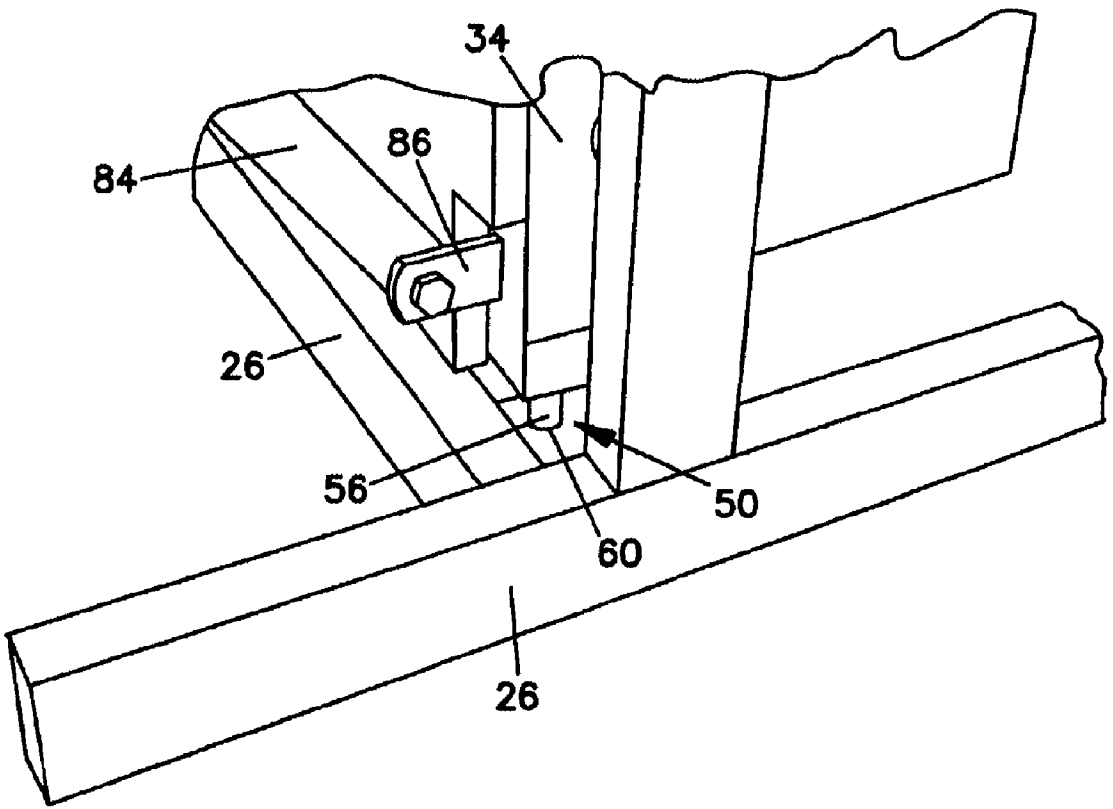
FIG. 9 details shows a detail view of a second lock receiver bracket for the folding bed of FIG. 1.

In addition, as shown in FIG. 9, the shaft 56 inserts into an orifice in a second receiver bracket 60, positioned at the base of the support frame 26. When the shaft 56 is inserted into the orifice of the second bracket 60, the bed assembly 22 cannot be moved from the storage position, shown in FIGS. 2 and 6. This prevents accidental unfolding of the bed assembly 22 and provides for a safer secure folding bed. In either position, the lock assembly 50 is easily released by depressing lock handle 52 that is flush with an outer portion of bed frame 34. This configuration minimizes accidental release of the lock assembly 50 and also eliminates an extended element, which may pose a safety hazard.

Referring now to FIGS. 6 and 7, the seat assembly 24 includes a seat back 70 and a seat bottom 72 that folds between a use position and a storage position. Seat back 70 is mounted substantially flush against the underside of the bed frame 34. The seat back 70 and seat bottom 72 may be cushioned but may also be hard surfaces. In addition, the cushions may be removable from the seat assembly 24. It will be appreciated that in the unfolded position, the seat assembly 24 provides comfortable seating and support for the backs of several seated users. Moreover, the seat assembly 24 includes folding seat legs 74 positioned near the extended edge of a seat frame 76 from the seat bottom 72 so that rigid support is provided. With the legs 72 and the support frame 26, substantial load capacity is provided to accommodate seating of several persons on seat assembly 24.

The seat frame 76 pivotally mounts on a seat linkage support strut 82 extending transversely from an underside of the bed frame 34. The seat legs 74 pivotally mount to the seat bottom frame 76 at an extended end. A link 84 mounts to a tab extending forward from the linkage support 28 of the support frame 26 and bends slightly to pivotally mount to the seat legs 74. The seat linkage 78 facilitates folding between the storage position shown in FIG. 6 and the unfolded use position shown in FIG. 7. Moreover, the linkage 78 allows for folding of the seat assembly 24 with the bed assembly 22 as shown in FIGS. 4–6. The various elements of the seat linkage 78 remain in the substantially same alignment and do not pivot relative to one another when the bed assembly 22 folds, with the exception of the link 84 that folds from a substantially vertical upward extending position shown in FIG. 6, to the outward horizontally extending position shown in FIG. 7.

Referring again to FIG. 2, the seat assembly 24 includes a lock 88. An engagement pin of the lock 88 extends from one of the seat legs 74 through the bed frame 34 to prevent movement of the seat assembly 24 relative to the bed frame 34. A spring-loaded actuator handle 80 is depressible to release the seat assembly 24 and allow folding of the seat assembly 24. The actuator handle is simply pivotally mounted to seat leg 74 and biased toward an engaged position. Pivoting of the actuator handle 80 retracts the pin of the lock 88 and allows unfolding of the seat assembly 24.

Figure 10:
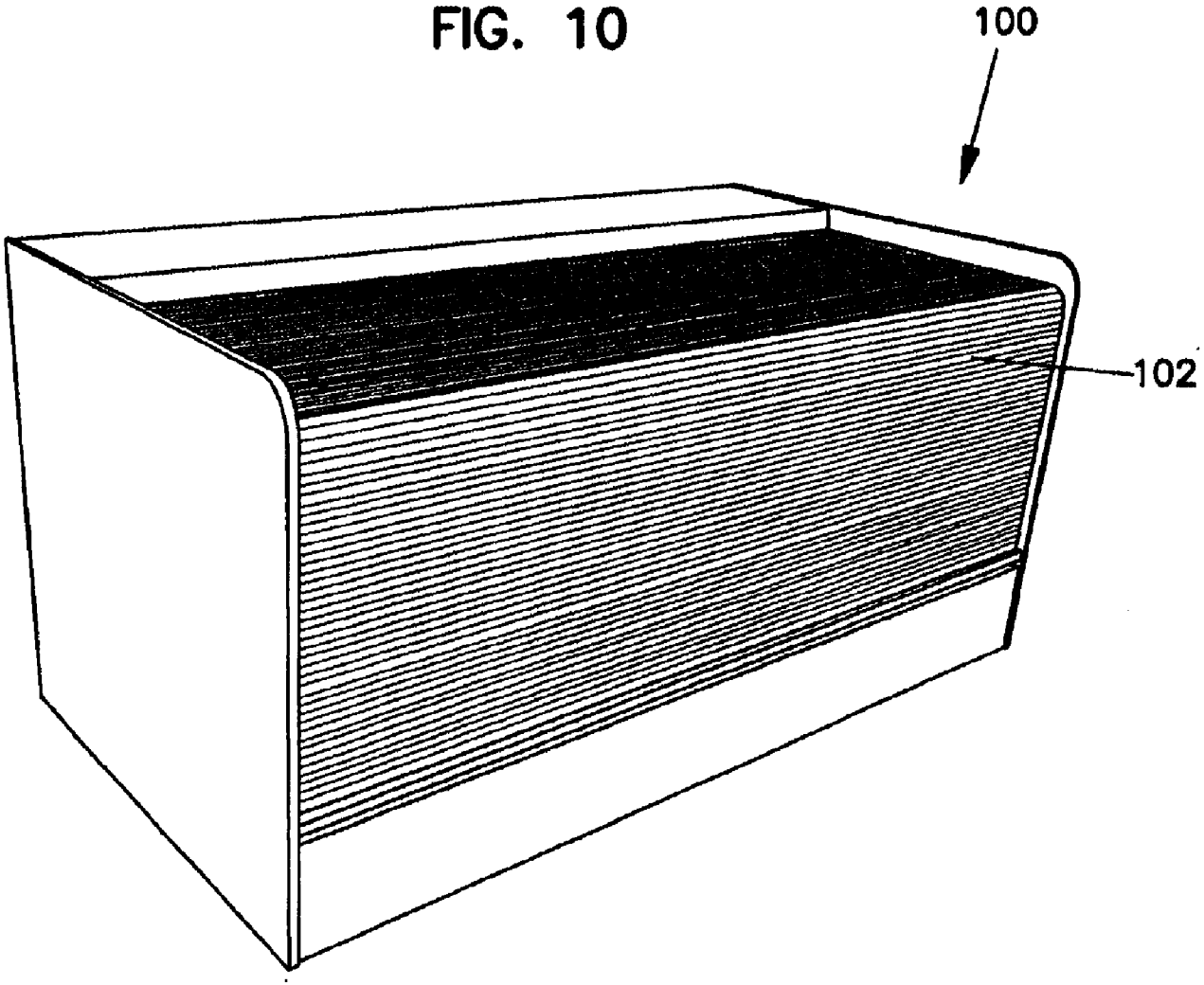
FIG. 10 shows a perspective view of a second embodiment of a folding bed having a cover cabinet according to the principles of the present invention.

Referring now to FIG. 10, there is shown a second embodiment of a folding bed, generally designated 100. The folding bed 100 is similar to folding bed 20, but includes a further housing 102 extending over the bed assembly and seat assembly so that a cabinet-type appearance is presented. The cover 102 may take on various configurations including a roll top-type configuration sliding on tracks, a folding cover with one or more panels pivotally mounted, or other well know cover arrangements. The cover 102 moves between a position covering the seat assembly 24 and bed assembly 22 and is removed or retracted for easy access and use.

Figure 11:
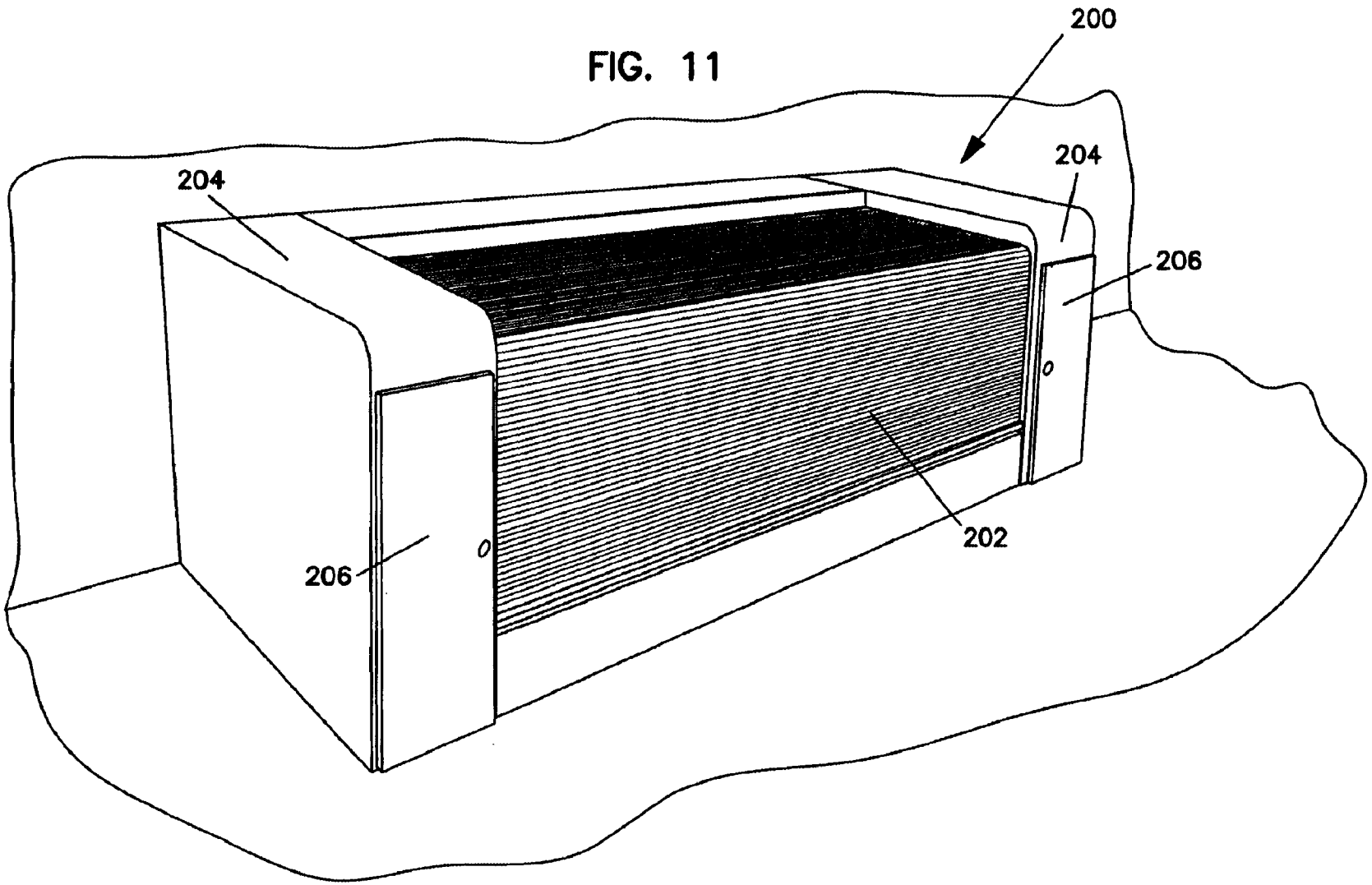
FIG. 11 shows a perspective view of a third embodiment of a folding bed having a cover cabinet and end storage compartments and mounted to a wall according to the principles of the present invention.
Figure 12:
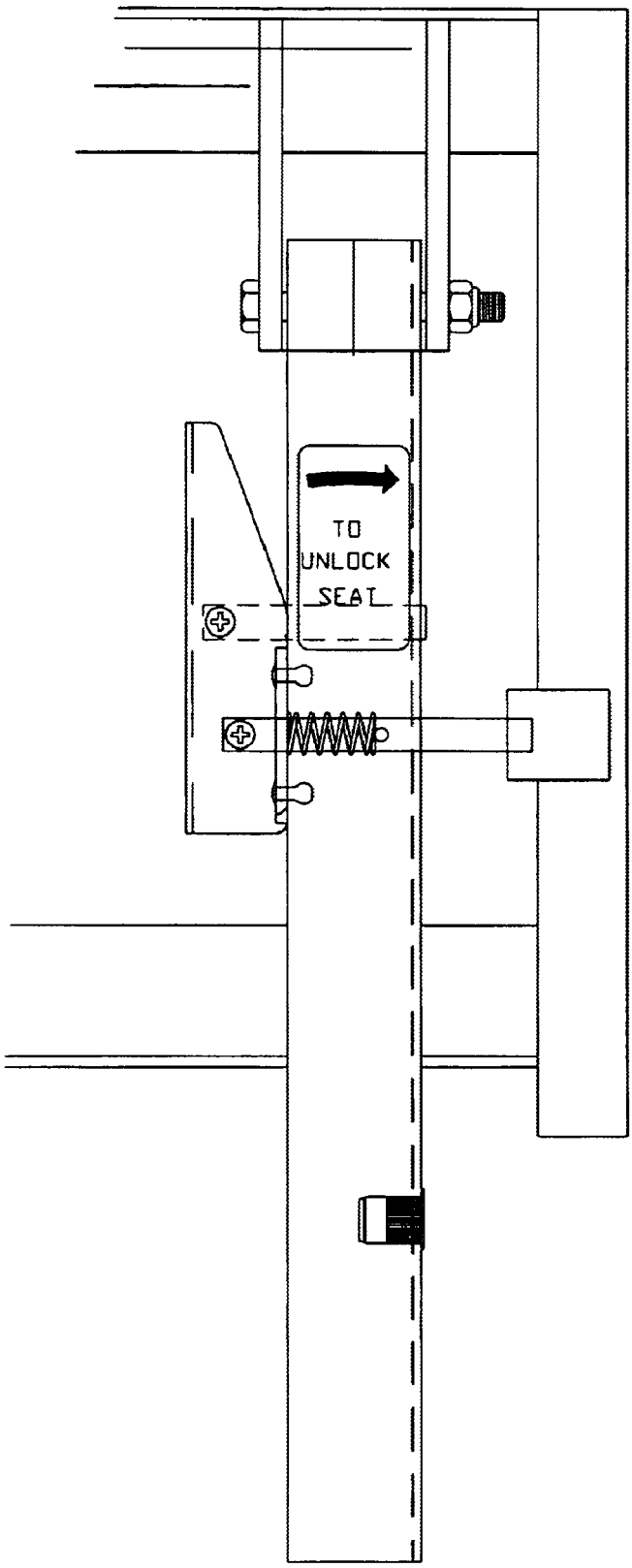
FIG. 12 shows an elevational view of a second embodiment of a seat lock in an engaged position for the folding bed of FIG. 1.
Figure 13:
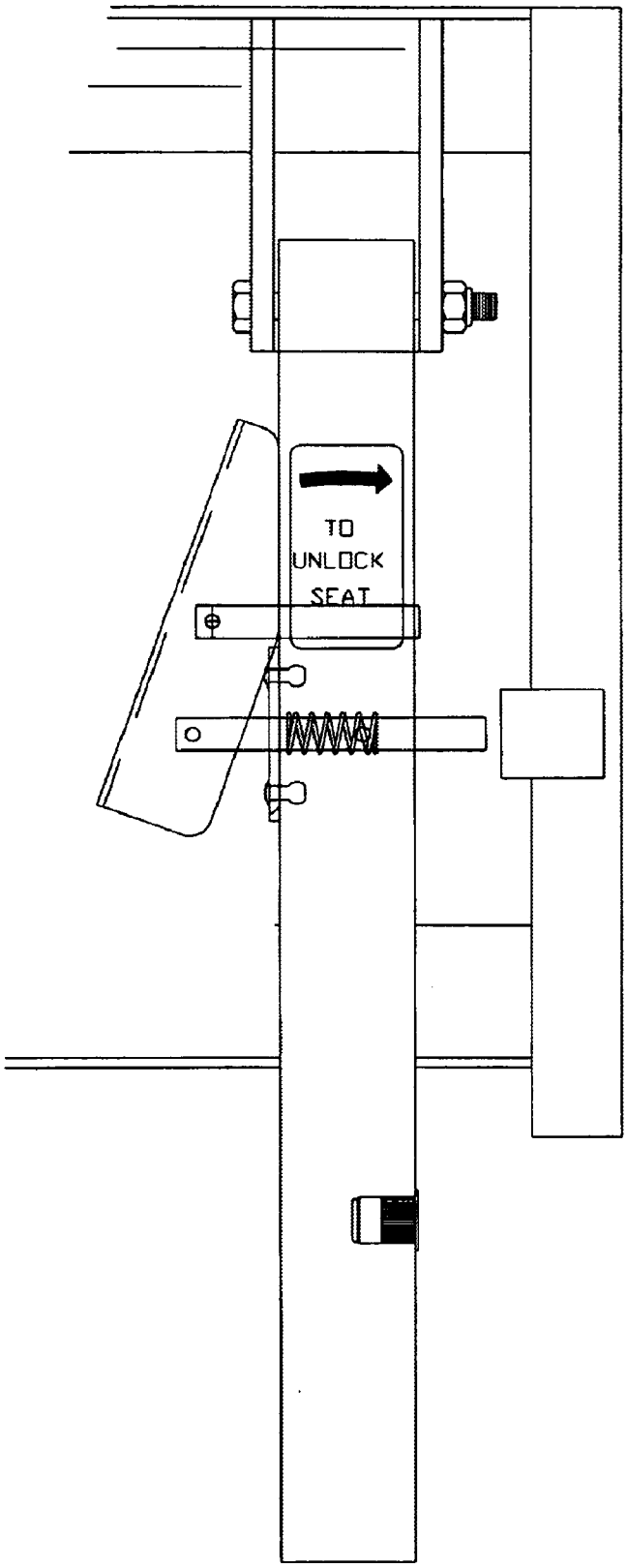
FIG. 13 shows an elevational view of the lock of FIG. 12 in a disengaged position.
Figure 14:
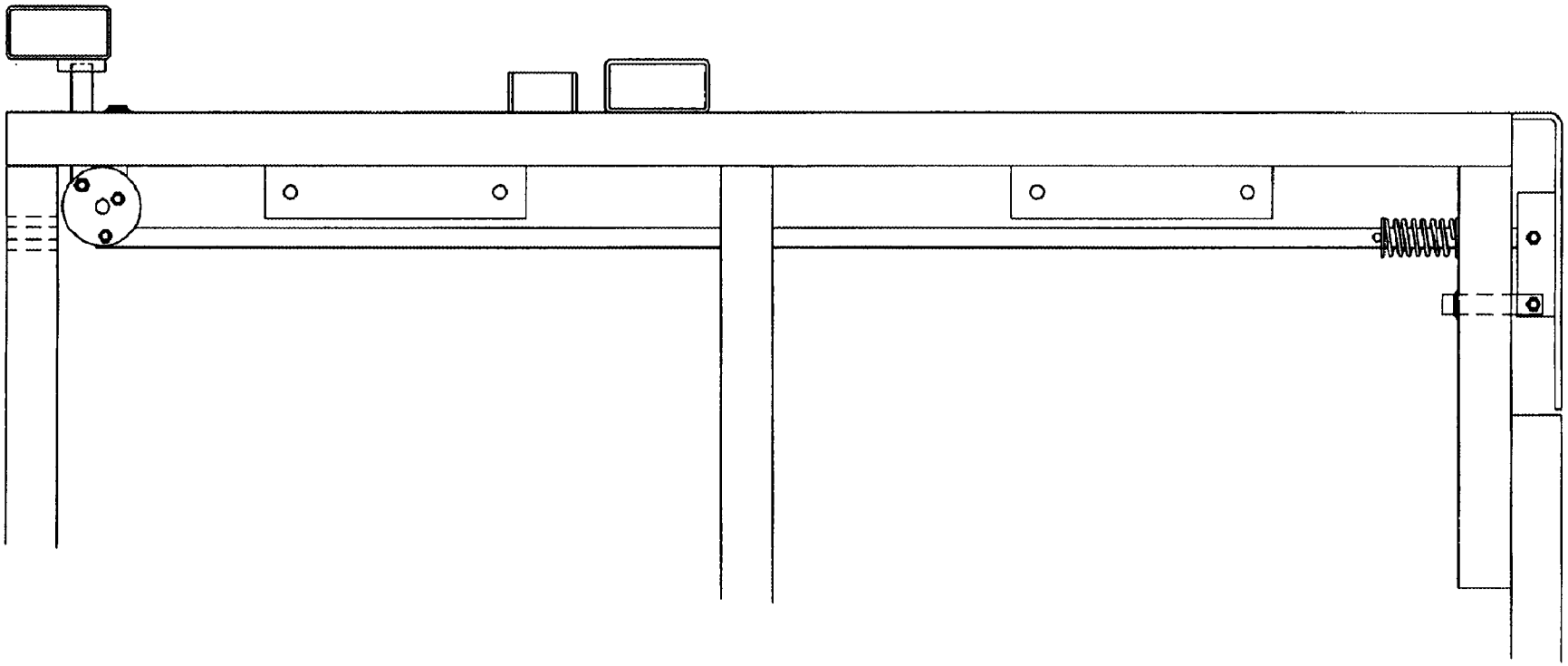
FIG. 14 shows a top plan view of a second embodiment of a bed lock for the folding bed of FIG. 1 in an engaged position.
Figure 15:
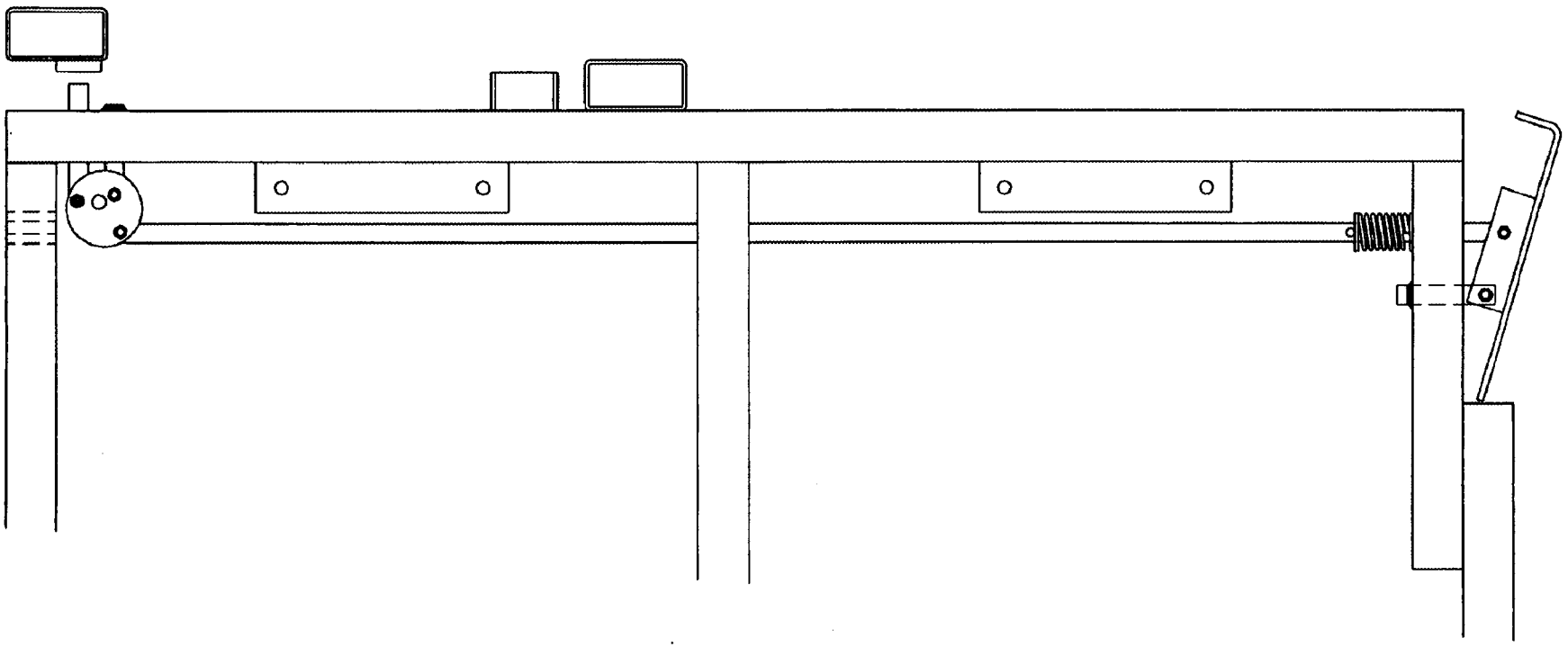
FIG. 15 shows a top plan view of the bed lock of FIG. 14 in a disengaged position.

Referring to FIG. 11, there is shown a third embodiment of a folding bed, generally designated 200. The folding bed 200 is similar to folding bed 100, with a housing 202 extending over the bed assembly and seat assembly so that a cabinet-type appearance is presented. As with bed 100, the cover 202 may take on various configurations including a roll top-type configuration sliding on tracks, as shown. Folding bed 200 also includes end storage compartments 204 at either end of the bed 200. The compartments 204 include front access doors 206 providing easy direct access for storage of pillows, bed linens and other accessories. The compartments 204 may also include top access rather than front access and a single compartment at one end of the bed, rather than a pair of compartments my be utilized, depending on needs and available space. The end compartments 204 may also be used with the rear storage compartment shown in the first embodiment. The bed 200 is shown permanently mounted directly to a wall. It can be appreciated that the first two embodiments of the folding bed, 20 and 100, may also be incorporated into a wall. In addition, the bed 200 may be configured as a stand-alone unit.

Although the present invention has been shown with both a bed assembly 22 and a seat assembly 24, it can be appreciated that the folding bed assembly may be utilized without the folding seat assembly 24. The present invention provides a sturdy economical folding bed that folds along its side rather than an end. Moreover, the folding bed may be incorporated into rooms and permanently inserted into a wall of the room or it may be utilized as a mobile unit. The support frame 26 may be fitted with casters that provide easy movement of the folding bed 20. With the bed 20 having three positions, it provides great versatility to any room that incorporates the folding bed in its design. In a first position with the bed assembly 22 folded and the seat assembly 24 folded, the folding bed 20 provides maximum floor space. With the bed assembly 22 folded and the seat assembly 24 unfolded, the folding bed 20 provides bench type seating for several persons, requiring minimal floor space. In a third position with the bed assembly 22 unfolded, the folding be 20 provides a bed in the same space.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A folding bed, comprising:

a support frame;

a bed assembly having a bed frame;

a first linkage connecting the bed frame to the support frame and folding the bed frame between a substantially horizontal use position and a substantially vertical storage position, the bed assembly including a bed leg, wherein first linkage automatically moves the bed leg between a storage position and a use position as the bed assembly is moved between the storage position and the use position;

a selectively foldable seat mounted to an underside of the bed frame, the seat including a seat leg and a second folding linkage automatically moving the seat leg between a storage position and a use position as the seat is moved between a storage position and a use position.

2. A folding bed according to claim 1, wherein the foldable seat comprises a back portion mounted against the underside of the bed frame, and a seat portion pivotally mounted to the bed frame.

3. A folding bed according to claim 1, wherein the seat leg pivotally mounts at an upper end to the seat portion and wherein a lower end engages the floor.

4. A folding bed according to claim 1, further comprising a lock for locking the bed frame in the substantially vertical position.

5. A folding bed according to claim 1, further comprising a lock for locking the bed frame in the substantially horizontal position.

6. A folding bed according to claim 1, further comprising a first lock for locking the bed frame in the substantially vertical position and for locking the bed frame in the substantially horizontal position.

7. A folding bed according to claim 6, further comprising a second lock for locking the seat at a first position.

8. A folding bed according to claim 1, wherein the bed includes a mattress mounted on the bed frame, and wherein the mattress is unfolded in the substantially vertical position and in the substantially horizontal position.

9. A folding bed according to claim 1, further comprising a storage compartment proximate the bed.

10. A folding bed according to claim 1, wherein the bed assembly includes a first and second side and a first and second end, and wherein the bed assembly folds along the first side.

11. A folding bed according to claim 1, wherein the support frame comprises a horizontal base element and a vertical element with a rectangular portion extending up from the base element and forward from the vertical element.

12. A folding bed according to claim 1, wherein the linkage comprises the support frame, a bed frame pivotally mounting to the support frame, a first leg pivotally mounted to the bed frame, and a folding link, pivotally mounting to the support frame and the first leg.

13. A folding bed according to claim 1, further comprising a gas spring connecting the support frame and the bed assembly.

14. A folding bed according to claim 1, further comprising a counterweight providing balance to the bed assembly during folding and unfolding.

15. A folding bed according to claim 1, further comprising a seat lock for locking the seat at a first position.

16. A folding bed according to claim 1, further comprising a first lock for the first linkage and a second lock for the second linkage.

17. A folding bed according to claim 1, wherein the folding bed is free standing and includes a cabinet covering the support frame, bed assembly and seat when at the storage position.

18. A folding bed comprising:

a support frame;

a bed assembly having a bed frame;

a linkage connecting the bed frame to the support frame and folding the bed frame between a substantially horizontal position and a substantially vertical position;

a selectively foldable seat mounted to an underside of the bed frame; and a first lock comprising a retractable pin and a pivoting lock actuator handle connected to the pin, wherein the pin engages a bracket to lock the bed assembly at the folded position and at the unfolded position.

19. A folding bed according to claim 18, wherein the lock actuator handle comprises a pivotally mounted member flush with a face of the frame in a non-actuated position.

20. A free standing folding bed and seat apparatus, comprising:

a support frame;

a bed assembly having a sides and ends, wherein the sides are longer than the ends;

a linkage connecting the bed frame to the support frame along one of the sides of the bed assembly and folding the bed frame between a substantially horizontal position and a substantially vertical position;

a folding seat mounted to an underside of the bed frame and a cover extending over the bed assembly and seat when the bed assembly is at the substantially vertical position.

21. A folding bed according to claim 20, wherein the seat further comprises a support leg supporting the seat at an upper end and engaging the floor, and a second linkage, wherein the second linkage extends and retracts the support leg as the seat is unfolded and folded.

22. A folding bed, comprising:

a support frame;

a bed assembly having a bed frame;

a first linkage connecting the bed frame to the support frame and folding the bed frame between a storage position and a use position;

a selectively foldable seat mounted to an underside of the bed frame;

a seat lock including a handle pivotally mounted flush with a face of the bed frame in a non-actuated position.

23. A folding bed according to claim 22, wherein the seat further comprises a support leg supporting the seat at an upper end and engaging the floor, and a second linkage, wherein the second linkage extends and retracts the support leg as the seat is unfolded and folded.

24. A folding bed according to claim 22, wherein the folding bed is free standing and includes a cabinet covering the support frame, bed assembly and seat when at the storage position.

* * * * *